US011230799B2

(12) United States Patent
de Vries

(10) Patent No.: US 11,230,799 B2
(45) Date of Patent: Jan. 25, 2022

(54) ARTIFICIAL TURF MAT AND METHOD FOR MANUFACTURING THEREOF

(71) Applicant: Greenfields B.V., Genemuiden (NL)

(72) Inventor: Hugo de Vries, Ridderkerk (NL)

(73) Assignee: Greenfields B.V., Genemuiden (NL)

( * ) Notice: Subject to any disclaimer, the term of this patent is extended or adjusted under 35 U.S.C. 154(b) by 302 days.

(21) Appl. No.: 15/428,164

(22) Filed: Feb. 9, 2017

(65) Prior Publication Data

US 2017/0211242 A1 Jul. 27, 2017

Related U.S. Application Data

(60) Division of application No. 12/801,614, filed on Jun. 17, 2010, now abandoned, which is a (Continued)

(30) Foreign Application Priority Data

Dec. 19, 2002 (NL) ..... 1022214

(51) Int. Cl.
*E01C 13/08* (2006.01)
*D03D 27/06* (2006.01)
(Continued)

(52) U.S. Cl.
CPC ..... *D03D 27/06* (2013.01); *D03D 1/00* (2013.01); *D03D 13/008* (2013.01); *D03D 27/02* (2013.01); *D03D 27/12* (2013.01); *D05C 15/12* (2013.01); *D05C 17/026* (2013.01); *D06N 7/0065* (2013.01); *E01C 13/08* (2013.01); *D03D 27/04* (2013.01); *D10B 2403/0111* (2013.01); *D10B 2505/18* (2013.01); *D10B 2505/202* (2013.01);
(Continued)

(58) Field of Classification Search
CPC ..... E01C 13/08; D03D 1/00; D03D 13/008; D03D 27/06; D03D 2700/60; D03D 27/02; D03D 27/04; Y10T 428/23957; Y10T 428/23936; Y10T 428/23921; Y10T 428/23929; D10B 2505/202; D06N 7/0065
See application file for complete search history.

(56) References Cited

U.S. PATENT DOCUMENTS 2,709,460 A * 5/1955 Hoeselbarth ..... D03D 27/06 139/403
2,765,001 A * 10/1956 Hoeselbarth ..... D03D 39/00 139/39
(Continued)

FOREIGN PATENT DOCUMENTS

EP 0678622 A 10/1995
GB 2357301 A 6/2001
(Continued)

*Primary Examiner* — Cheryl Juska
(74) *Attorney, Agent, or Firm* — N.V. Nederlandsch Octrooibureau; Catherine A. Shultz; Katelyn J. Bernier

(57) ABSTRACT

An artificial turf mat includes a backing and a number of protruding artificial grass blades divided into rows and connected thereto. The mutual distance between successive blades in a row is substantially equal to the distance between adjacent rows and amounts to at least 10 mm. Such an artificial turf mat can be used to form artificial turf fields, for example, on which sports, and in particular ball sports, are played.

18 Claims, 3 Drawing Sheets

Related U.S. Application Data continuation-in-part of application No. 10/539,439, filed as application No. PCT/NL03/00918 on Dec. 19, 2003, now abandoned.

(51) Int. Cl.

| | |
|---|---|
| ***D03D 1/00*** | (2006.01) |
| ***D06N 7/00*** | (2006.01) |
| ***D03D 13/00*** | (2006.01) |
| ***D03D 27/02*** | (2006.01) |
| ***D03D 27/12*** | (2006.01) |
| ***D05C 15/12*** | (2006.01) |
| ***D05C 17/02*** | (2006.01) |
| *D03D 27/04* | (2006.01) |

(52) U.S. Cl.

CPC ..... *Y10T 428/23921* (2015.04); *Y10T 428/23929* (2015.04); *Y10T 428/23936* (2015.04); *Y10T 428/23957* (2015.04)

(56) References Cited

U.S. PATENT DOCUMENTS

| | | | | |
|---|---|---|---|---|
| 3,332,828 | A * | 7/1967 | Faria | D03D 25/00 112/410 |
| 3,513,062 | A | 5/1970 | Vinicki | |
| 3,940,522 | A | 2/1976 | Wessells | |
| 4,356,220 | A | 10/1982 | Benedyk | |
| 5,601,886 | A * | 2/1997 | Ishikawa | E01C 13/08 273/DIG. 13 |
| 6,029,397 | A | 2/2000 | Motz et al. | |
| 6,242,062 | B1 | 6/2001 | De Vries | |
| 6,299,959 | B1 | 10/2001 | Squires et al. | |
| 6,338,885 | B1 | 1/2002 | Prevost | |
| 6,372,310 | B2 | 4/2002 | De Vries | |
| 6,491,991 | B2 | 12/2002 | Seaton | |
| 6,753,049 | B2 | 6/2004 | De Vries | |
| 6,955,841 | B2 | 10/2005 | Weghuis et al. | |
| 7,168,883 | B2 | 1/2007 | Waterford | |
| 7,357,966 | B2 | 4/2008 | Dippie et al. | |
| 7,992,595 | B2 | 8/2011 | Debaes et al. | |
| 8,133,123 | B2 | 3/2012 | De Vries et al. | |
| 8,491,974 | B2 | 7/2013 | De Vries | |
| 8,557,363 | B2 * | 10/2013 | Van Balen | E01C 13/08 428/89 |
| 10,227,716 | B2 * | 3/2019 | de Vries | D06N 7/0065 |
| 2001/0007700 | A1 * | 7/2001 | de Vries | E01C 13/08 428/17 |
| 2002/0028307 | A1 | 3/2002 | Prevost | |
| 2003/0099787 | A1 * | 5/2003 | Fink | D02G 3/445 428/17 |
| 2003/0108688 | A1 | 6/2003 | De Vries | |
| 2003/0157275 | A1 | 8/2003 | Weghuis et al. | |
| 2004/0229007 | A1 | 11/2004 | Motz et al. | |
| 2006/0137758 | A1 | 6/2006 | Debaes et al. | |
| 2006/0204710 | A1 | 9/2006 | De Vries | |
| 2006/0216458 | A1 * | 9/2006 | Gilman | B32B 3/085 428/87 |
| 2007/0237921 | A1 | 10/2007 | Knapp et al. | |
| 2008/0124496 | A1 | 5/2008 | Avery | |
| 2009/0050037 | A1 * | 2/2009 | Hall | D05C 15/12 112/80.32 |
| 2009/0162578 | A1 | 6/2009 | Van Balen et al. | |
| 2009/0317569 | A1 | 12/2009 | Debaes et al. | |
| 2010/0092701 | A1 | 4/2010 | Debaes et al. | |
| 2010/0092702 | A1 | 4/2010 | Debaes | |
| 2010/0101628 | A1 * | 4/2010 | Poe | C08L 51/08 136/244 |
| 2010/0255223 | A1 | 10/2010 | De Vries | |
| 2014/0050866 | A1 * | 2/2014 | Ejtaszewski | D06N 7/0073 428/17 |
| 2014/0144542 | A1 * | 5/2014 | Siebert | E01C 13/08 139/391 |

FOREIGN PATENT DOCUMENTS

| | | | | |
|---|---|---|---|---|
| JP | 06-042988 | U | 7/1994 | |
| JP | 07-004505 | U | 1/1995 | |
| JP | 09-273109 | A | 10/1997 | |
| JP | 2000-027111 | A | 1/2000 | |
| JP | 3086213 | U | 3/2002 | |
| JP | 2002088708 | A | 3/2002 | |
| JP | 2002-242120 | A | 8/2002 | |
| WO | 98/40559 | A | 9/1998 | |
| WO | WO-0148322 | A1 * | 7/2001 | E01C 13/08 |
| WO | WO-2006075241 | A1 * | 7/2006 | E01C 13/08 |

* cited by examiner

ARTIFICIAL TURF MAT AND METHOD FOR MANUFACTURING THEREOF

BACKGROUND

The invention relates to an artificial turf mat, comprising a backing and a number of protruding artificial grass blades divided into rows and connected thereto. Such an artificial turf mat is generally known and is used to form artificial turf fields on which for instance sports, and in particular ball sports, are played. The artificial turf fields are herein formed by laying artificial turf mats on a flat, generally slightly resilient ground and then spreading a layer of loose filling material, for instance sand or a mixture of sand and rubber granules, over these artificial turf mats. The layer of filling material herein has a thickness such that the artificial grass blades protrude thereabove, so that the artificial turf field creates the same impression as a natural grass field.

Known artificial turf mats have the drawback however that, as a result of the manner in which they are manufactured, the artificial grass blades in a row stand relatively close to each other, while the mutual distance between the rows is often considerably larger. This has the consequence that an artificial turf field on the basis of such an artificial turf mat will display different properties in different directions. In ball sports this can result in a ball not rolling uniformly over the field. Owing to this irregularity the chance of injury, for instance as a result of performing a sliding tackle, is also relatively great when such a sliding tackle is made in the direction of the rows. Tight packing of the blades in a row has the further result that the filling material is there held fast more firmly than between the rows, whereby local compaction and thereby hardening of the field can occur.

SUMMARY

The invention therefore has for its object to provide an artificial turf mat of the above described type wherein these drawbacks do not occur. This is achieved according to the invention in that the mutual distance between successive blades in a row is substantially equal to the distance between adjacent rows and amounts to at least 10 mm.

The distance between the blades and the row spacing preferably amounts to at least 13 mm, and more preferably to at least 16 mm. Owing to such a large gap between the individual blades the filling material can be readily loosened periodically, whereby compression or compaction thereof is avoided. The risk of injury as a result of for instance studs getting caught in the artificial turf mat, or a relatively high rotational resistance thereof, is also reduced by this large interspacing.

The backing and the blades can be formed and mutually connected by weaving. It is however recommended for reasons of production cost that the backing is a fabric and the blades are connected thereto by tufting.

The blades are advantageously formed from a continuous fibre. This greatly simplifies production of the artificial turf mat.

In order in this case to ensure an adequate connection of the blades to the backing despite the relatively large interspacing between the blades, at least one support loop protruding less far from the backing is preferably formed in each case between successive blades. For production engineering purposes it is recommended here that the support loops are formed outside the row of blades. The support loops can even be formed from another fibre material than the blades.

The blades and/or the support loops are preferably formed from a relatively thick and/or heavy fibre material. By making use of a fibre material, for instance a yarn with a high yarn weight (Dtex number) or a large yarn volume, optionally built up from a bundle of different yarns, a well covered mat can be obtained which provides a natural (green) appearance. An additional advantage is that a studded structure can thus be formed on the backing side of the artificial turf mat, particularly when offset support loops, therefore formed outside the row of blades, are applied. This studded structure contributes to the shock absorption and energy restitution by the artificial turf when the artificial turf mat is laid on a flat stable ground such as asphalt, stone chippings or rigid geotextile.

The blades are advantageously formed from monofilament fibre. A filling material to be arranged on the artificial turf mat is hereby less confined than would be the case with the use of fibrillated fibres, whereby compaction of the filling material, and thereby hardening of the artificial turf field, can be prevented.

The invention also relates to an artificial turf field formed by an artificial turf mat as described above and a layer of loose filling material arranged thereon, the thickness of which is less than the length of the artificial grass blades.

The invention further relates to a method for forming an artificial turf mat, comprising of supplying a backing material, supplying an artificial turf material, forming a backing from the backing material, and connecting blades of the artificial turf material divided into rows to the backing. Such a method is also generally known.

The method according to the present invention is distinguished from the known methods in that the blades are connected to the backing such that their mutual spacing in a row is substantially equal to the mutual distance between adjacent rows and amounts to at least 10 mm.

When the backing material is formed into a fabric and the blades are connected to the fabric by tufting, it is recommended that the fabric is guided along a series of reciprocally moving tufting needles placed adjacently of each other at the row distance, and the speed of forward movement of the fabric and the stroke speed of the tufting needles are adjusted to each other such that between successive strokes of the tufting needles the fabric is displaced substantially through the row distance. The desired mutual distance between the blades can thus be ensured in simple manner. This is achieved even more simply when the fabric is stopped after each displacement through the row distance.

Finally, the invention further relates to a method for forming an artificial turf field by arranging on a ground an artificial turf mat as described above and spreading thereover a layer of loose filling material to a thickness which is less than the length of the artificial grass blades.

BRIEF DESCRIPTION OF THE DRAWINGS

The invention is now elucidated on the basis of a number of embodiments, wherein reference is made to the annexed drawing, in which.

DETAILED DESCRIPTION

Figure 1:
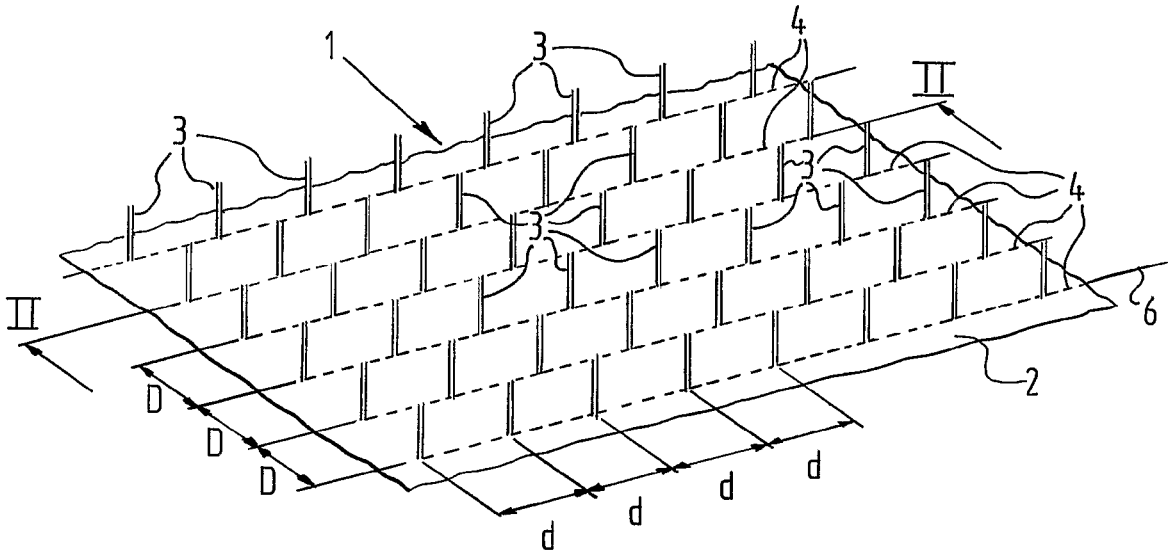
FIG. 1 shows a schematic perspective view of a part of an artificial turf mat according to a first embodiment of the invention.

An artificial turf mat 1 (FIG. 1) comprises a backing 2, for instance in the form of a woven fabric or non-woven, to which is attached a large number of protruding artificial grass blades 3. Blades 3 are distributed uniformly over rows 4 which are likewise uniformly distributed with an inter-spacing D. The mutual distance between blades 3 in a row 4 is designated with d. According to the present invention these distances are substantially corresponding and it is therefore the case that D~d. A uniform distribution of the artificial grass blades over mat 1 is hereby obtained, which results in homogeneous properties in all directions of a playing field based on this artificial turf mat 1.

Figure 3:
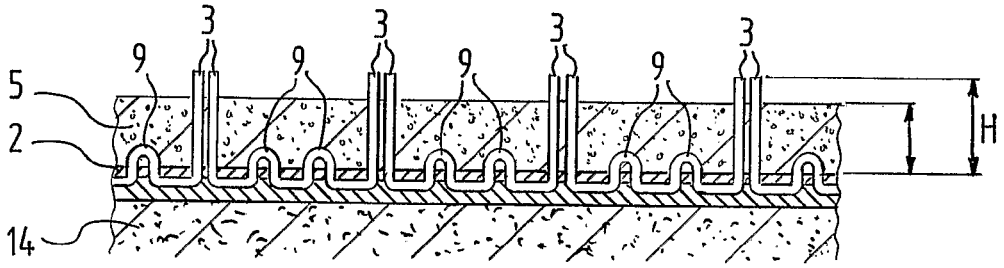
FIG. 3 is a cross-sectional view corresponding with FIG. 2 of an artificial turf field based on an alternative embodiment of the artificial turf mat.

In order to avoid studs of sports footwear catching in the blades 3, and also to prevent a filling material 5 (FIG. 3) spread on artificial turf mat 1 being held too firmly in place, whereby this material would be compacted and hardened, the mutual distances d, D are chosen to be relatively large. According to the invention these two distances amount to 10 mm or more, but more preferably to 13 mm or more, and most preferably to more than 16 mm.

Figure 2:
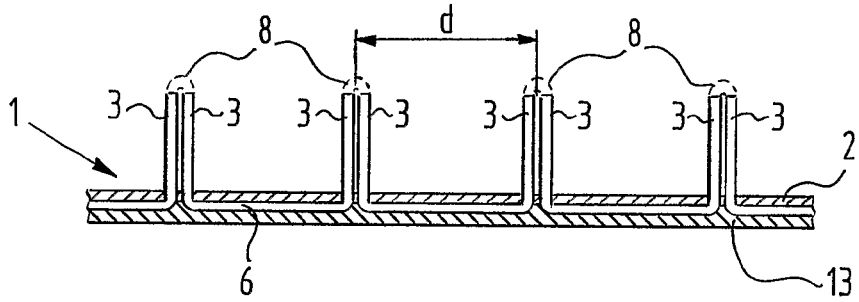
FIG. 2 shows a cross-section along line II-II in FIG. 1.
Figure 8:
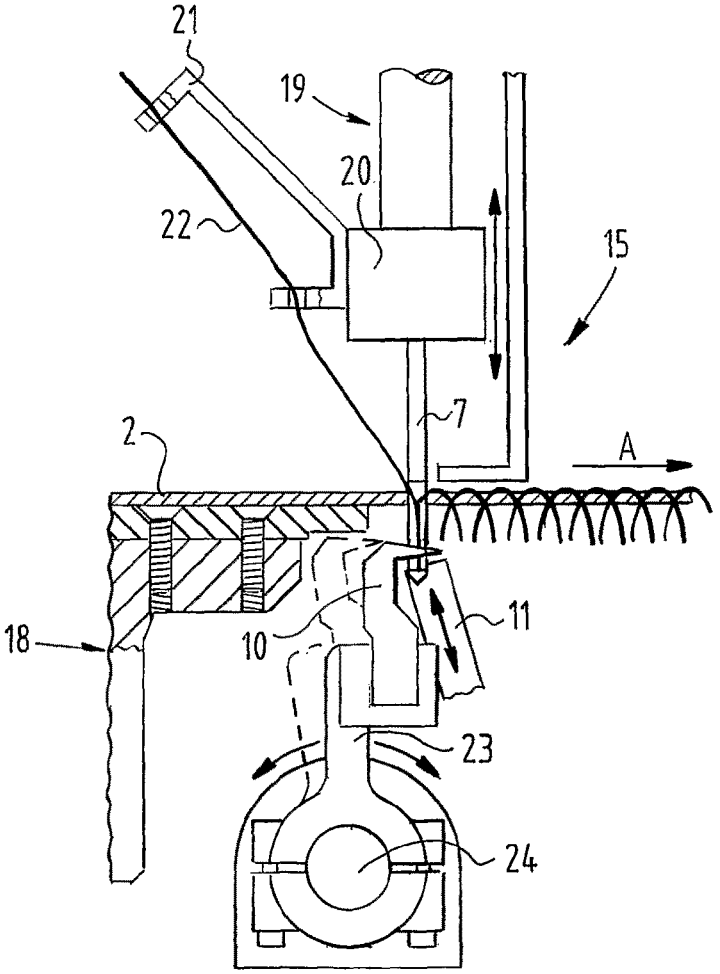
FIG. 8 is a schematic view of a tufting machine with which an artificial turf mat according to the invention can be manufactured.

In the shown embodiment the artificial grass blades 3 are tufted into backing 2. Use is herein made for each row 4 of a continuous thread 6, here of monofilament fibre, which is pressed into backing 2 in a regular pattern by an up and downward moving tufting needle 7 (FIG. 8) and then held fast by looping hooks 10, with the formation of loops 8 (FIG. 2). During so-called cut pile tufting these loops 8 are severed or cut by means of knives 11 co-acting with looping hooks 10, whereby two artificial grass blades 3 are formed in each case standing adjacently of each other.

Where mention is made in this text of the mutual distance d between adjacent blades, this does not therefore refer to the distance between blades 3 formed from a single loop 8, but to the distance between two loops 8 and the pairs of blades 3,3 formed therefrom.

Figure 4:
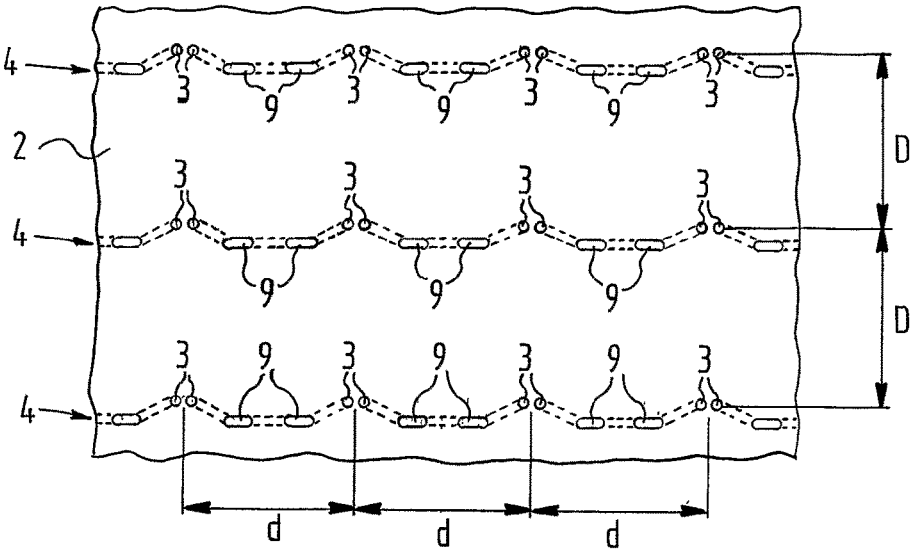
FIG. 4 is a top view of the artificial turf mat of FIG. 3.

In order to strengthen the connection between the continuous tuft thread 6 and backing 2, one or more further support loops 9 can be tufted between successive (pairs of) blades 3. These support loops 9 protrude less far through backing 2 than the loops 8 from which the blades 3 are formed, nor are they cut open. Use can be made to form these support loops of separate or secondary looping hooks, and so as to prevent conflicts between these secondary looping hooks and the looping hooks for forming of blades 3, the support loops 9 are preferably formed outside the row 4 (FIG. 4).

Blades 3 are otherwise fixed in the usual manner in backing 2 after the tufting by providing the latter on the underside with an adhesive layer 13 which can be glued or welded to backing 2.

Figure 5:
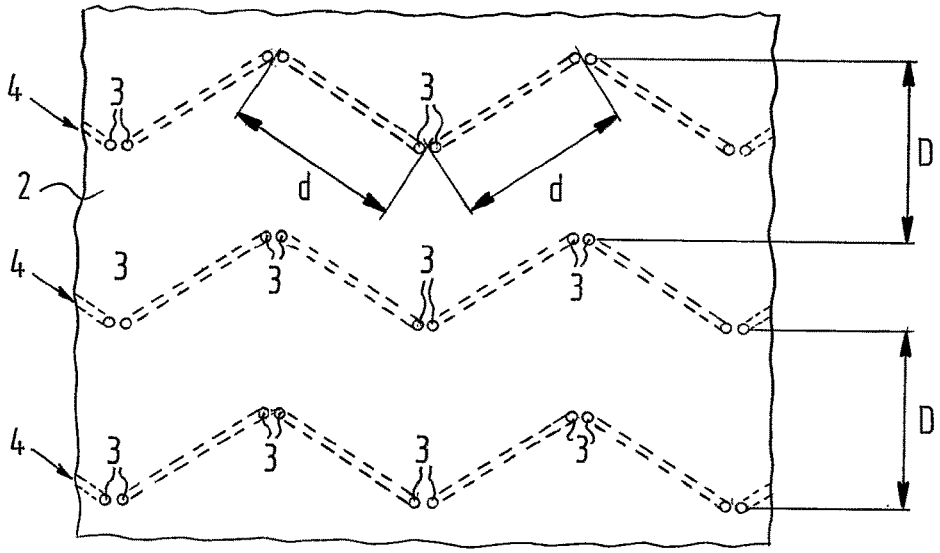
FIG. 5 is a top view of an artificial turf mat with an alternative orientation of the rows of artificial grass blades.

For application of the invention it is not essential for the rows 4 to run straight. A different pattern, for instance with zigzag rows 4 (FIG. 5), can also be envisaged as long as the mutual distance between the different artificial grass blades (or pairs of blades) 3 is substantially equal, and greater than 10 mm.

For forming of the artificial turf field 12 the artificial turf mat 1 is laid on a flat, slightly resilient ground 14 (FIG. 3) and a layer of loose filling material 5, for instance sand or a mixture of sand and rubber granules, is spread thereover. The thickness h of the layer of filling material 5 is chosen to be smaller than the height H of artificial grass blades 3, so that these latter protrude above filling material 5.

Figure 6:
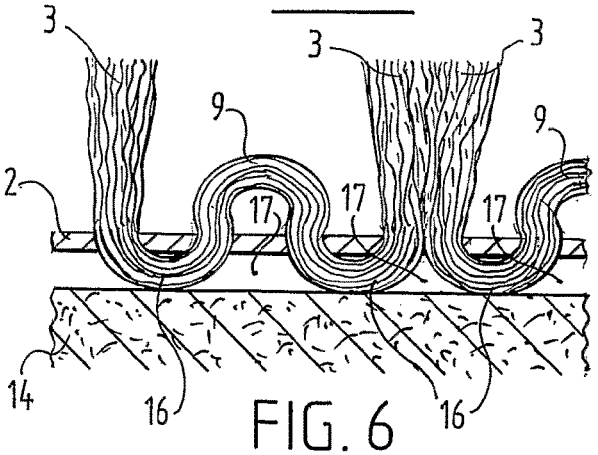
FIG. 6 is a cross-sectional view corresponding with FIGS. 2 and 3 of an artificial turf field with yet another embodiment of the artificial turf mat.

When blades 3 and support loops 9 are formed from a relatively thick fibre material or for instance a composite yarn bundle, the fibre or yarn segments 16 between blades 3 and support loops 9 protrude relatively far on the underside of backing 2, whereby intermediate spaces or air chambers 17 are as it were formed therebetween (FIG. 6). These intermediate spaces 17 contribute toward the shock absorption and energy restitution of artificial turf field 12, which is particularly important when it is laid on a relatively flat and hard ground.

The artificial turf mat 1 as shown here can be manufactured on a tufting machine 15 which is of conventional construction and forms no part of the invention. Tufting machine 15 is provided with a frame with a bed 18 and a head 19 arranged thereabove. Present on the infeed side of bed 18 is a feed roller (not shown here) for the material of backing 2, while on an opposite side there is arranged a wind-up roller (not shown) for the tufted artificial turf mat 1, so that the material of the backing is transported over the bed in the direction of arrow A.

Situated in head 19 is an up and downward movable bar 20 in which is received a series of tufting needles 7. The mutual distance between tufting needles 7 herein defines the row distance D. Guides 21 are further fixed to needle bar 20 for carrying to the needles 7 the fibre material 22 from which the blades 3 are formed.

A number of looping hooks 10 corresponding with the number of tufting needles 7 are arranged in bed 18. These looping hooks 10 are fixed to arms 23 which are pivotable on a shaft 24, so that looping hooks 10 are movable roughly parallel to the backing material and thus roughly transversely of needles 7 to take over the loops placed through the backing material by needles 7. Adjacently of looping hooks 10 are further arranged the knives 11 co-acting therewith which cut open the loops to form said pairs of blades 3.

The wind-up roller, needle bar 20 and pivot shaft 24 are driven by (servo) motors (not shown here) which are all connected to a control system. The insertion depth for instance of needles 7 can hereby be set, while by regulating the motors the insertion speed can be adapted to the winding-up speed such that between two successive insertion movements of needles 7 the material of backing 2 is moved forward each time through the distance d corresponding with the row distance D. In addition, it is possible to interrupt the winding-up each time the tufting needles 7 are inserted into backing 2.

Figure 7:
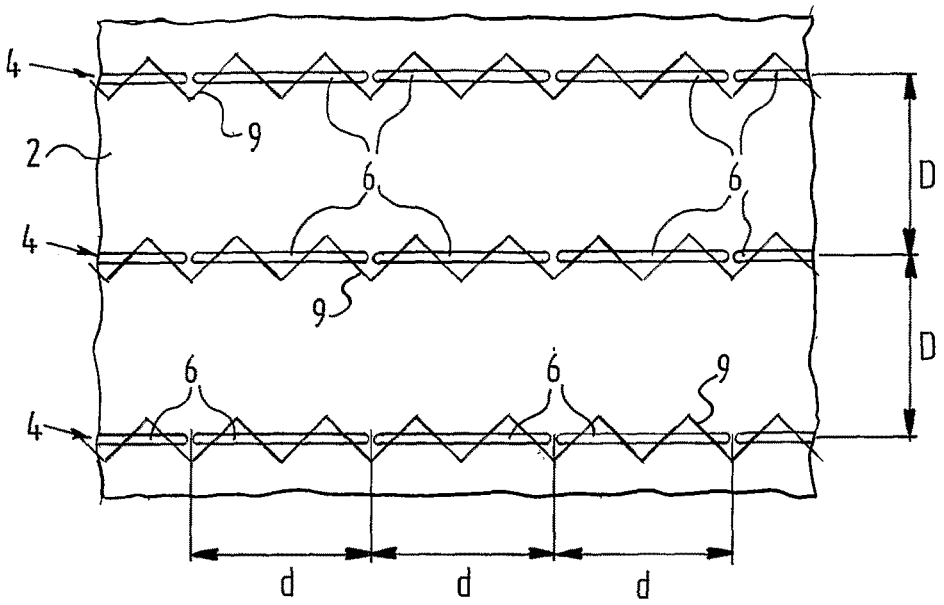
FIG. 7 is a bottom view of an artificial turf mat with separately formed blades and support loops.

Use could optionally be made for the tufting of a tufting machine with two needle bars movable independently of each other and looping hooks and knives co-acting with the bars, such as described for instance in GB-A-2 357 301. The support loops 9 could hereby be tufted independently of blades 3. For the support loops 9, which could optionally be arranged crosswise over fibre 6 between successive (pairs of) blades 3 (FIG. 7), use could then be made of another fibre material, for instance a much thinner yarn.

Although the invention is elucidated above with reference to an embodiment, it will be apparent that the invention is not limited thereto. The artificial grass blades 3 could thus be connected in a different way to backing 2. Backing 2 could for instance be woven, wherein artificial grass blades 3 could be co-woven at the same time. Materials other than those discussed here are also conceivable. The artificial grass blades 3, or at least the outer ends thereof, could thus be fibrillated. It is also conceivable for the loops 8 not to be cut open, whereby double blades 3 would in fact be formed.

The scope of the invention is therefore defined solely by the now following claims.

The invention claimed is:

1. A method of preventing compaction and of strengthening a connection of blades to a backing in a woven artificial turf mat, the method comprising:

weaving a backing and a plurality of artificial grass blades sufficient to provide coverage of the artificial turf, wherein the artificial grass blades are formed by yarn bundles;

whereby the artificial grass blades protrude to a height above the backing and wherein said yarn bundles also form at least one support loop between successive blades protruding less far from the backing than the blades such that the blades are distributed uniformly throughout the mat, and a distance between each blade and an adjacent blade is at least 10 mm, whereby the support loops are continuous with and terminate as the artificial grass blades, and ensure connection of the blades to the backing; and providing a granular infill material to be spread over the backing.

2. The method of claim 1, wherein the step of weaving comprises weaving the blades with the backing forming rows with a distance between adjacent blades in a row being substantially equal to a distance between adjacent rows.

3. The method of claim 1, and further comprising:

spreading the granular infill material over the backing between blades.

4. The method of claim 1, wherein the yarn bundles comprise monofilament fibre yarns.

5. The method of claim 1, wherein the yarn bundles are connected to the backing in a W shape, whereby a support loop forms a central portion of the W and successive blades form uprights of the W.

6. A woven artificial turf mat for use with a granular infill, the artificial turf mat comprising:

a backing; and a plurality of protruding artificial grass blades formed by yarn bundles divided into rows and connected to the backing;

wherein the backing and the blades are formed and mutually connected by weaving and wherein the artificial grass blades protrude to a height above the backing and wherein said yarn bundles also form at least one support loop between successive blades whereby the support loops are continuous with and terminate as the artificial grass blades, the support loops protruding less far from the backing than the blades, wherein a distance between successive blades in a row is substantially equal to a distance between rows, wherein the distance between successive blades is at least 10 mm.

7. The artificial turf mat of claim 6, wherein the distance between successive blades is at least 13 mm.

8. The artificial turf mat of claim 6, wherein the yarn bundles are formed from continuous fibres.

9. The artificial turf mat of claim 6, and further comprising a quantity of rubber granules arranged on the backing between the blades.

10. The artificial turf mat of claim 6, wherein the yarn bundles are composite yarn bundles comprising multiple monofilaments.

11. The artificial turf mat of claim 10, wherein the composite yarn bundles comprise multiple monofilaments that differ from one another.

12. The artificial turf mat of claim 6, wherein the blades protrude to a substantially similar height above the backing.

13. The woven artificial turf mat of claim 6, wherein the yarn bundles are connected to the backing in a W shape, whereby a support loop forms a central portion of the W and successive blades form uprights of the W.

14. An artificial turf field, comprising an artificial turf mat as claimed in claim 6 and a layer of granular filling material arranged thereon, the thickness of which is less than a height of the artificial grass blades.

15. A woven artificial turf with homogenous properties in all directions, the turf comprising:

a backing;

a plurality of artificial grass blades formed by yarn bundles divided into rows and connected to the backing by weaving such that a distance between successive blades in a row is substantially equal to a distance between adjacent rows so that the artificial turf has uniform properties in all directions, wherein the blades protrude to a height above the backing and wherein said yarn bundles also form at least one support loop between successive blades whereby the support loops are continuous with and terminate as the artificial grass blades, to ensure connection of the blades to the backing, the support loops protruding less far from the backing than the blades; and loose filling material comprising granular infill spread over the backing between the blades.

16. The artificial turf of claim 15, wherein the distance between successive blades is at least 10 mm.

17. The artificial turf of claim 15, wherein each yarn bundle is a bundle comprising multiple different monofilament yarns.

18. The woven artificial turf of claim 15, wherein the yarn bundles are connected to the backing in a W shape, whereby a support loop forms a central portion of the W and successive blades form uprights of the W.

* * * * *